US010443918B2

(12) United States Patent
Li et al.

(10) Patent No.: US 10,443,918 B2
(45) Date of Patent: Oct. 15, 2019

(54) CONFIGURABLE INSULATED STORAGE CONTAINER

(71) Applicant: Otter Products, LLC, Fort Collins, CO (US)

(72) Inventors: Shanshan Li, Fort Collins, CO (US); Jonathan H. Guerdrum, Fort Collins, CO (US); Douglas A. Kempel, Fort Collins, CO (US); Jonathan B. Rayeski, Fort Collins, CO (US); Kyle M. Fanning, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 15/982,059

(22) Filed: May 17, 2018

(65) Prior Publication Data

US 2018/0335241 A1 Nov. 22, 2018

Related U.S. Application Data

(60) Provisional application No. 62/508,099, filed on May 18, 2017.

(51) Int. Cl.
*B65D 5/06* (2006.01)
*F25D 3/08* (2006.01)
(Continued)

(52) U.S. Cl.
CPC ..... *F25D 3/08* (2013.01); *B65D 25/06* (2013.01); *B65D 81/3816* (2013.01);
(Continued)

(58) Field of Classification Search
CPC ..... F25D 3/08; F25D 2303/081; F25D 2303/0832; F25D 2303/0843;
(Continued)

(56) References Cited

U.S. PATENT DOCUMENTS 1,468,563 A 9/1923 Girard
2,627,993 A 2/1953 Hafner
(Continued)

FOREIGN PATENT DOCUMENTS

EP 3061704 A1 8/2016
WO 2004029526 A1 4/2004
(Continued)

OTHER PUBLICATIONS

Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.
(Continued)

*Primary Examiner* — J. Gregory Pickett
*Assistant Examiner* — Niki M Eloshway

(57) ABSTRACT

A portable insulated storage container includes an insulated body, an insulated lid, and a retainer. The insulated body has an internal cavity for storing one or more items. The internal cavity is selectively and reversibly configurable into two or more storage areas. The insulated lid engages the insulated body to close the internal cavity. The insulated lid includes receptacles each configured for receiving a cold pack or other thermal device. Each of the receptacles aligns with a respective one of the storage areas when the insulated lid engages the body. The retainer removably retains the cold pack in one of the receptacles.

20 Claims, 8 Drawing Sheets

(51) Int. Cl.
*B65D 81/38* (2006.01)
*B65D 25/06* (2006.01)
*B65D 90/34* (2006.01)

(52) U.S. Cl.
CPC ..... *F25D 2303/081* (2013.01); *F25D 2303/0832* (2013.01); *F25D 2303/0843* (2013.01); *F25D 2303/0844* (2013.01); *F25D 2331/804* (2013.01)

(58) Field of Classification Search
CPC ..... F25D 2303/0844; F25D 2331/804; B65D 25/06; B65D 81/3816
USPC ..... 220/533, 521, 522, 501, 592.03, 592.1, 220/592.25, 592.27
See application file for complete search history.

(56) References Cited

U.S. PATENT DOCUMENTS 3,347,060 A 10/1967 Barkan
3,395,550 A 8/1968 Dungan
3,850,398 A 11/1974 Kantor
3,868,829 A 3/1975 Mann et al.
3,939,986 A 2/1976 Pierro
4,024,731 A * 5/1977 Branscum ..... B65D 81/3823 215/385
4,213,310 A * 7/1980 Buss ..... A47J 41/0044 206/544
D275,822 S 10/1984 Gatland et al.
4,515,421 A 5/1985 Steffes
4,560,128 A 12/1985 Willeby et al.
4,606,461 A 8/1986 Bolton
RE32,740 E 8/1988 Steffes
4,841,661 A 6/1989 Moore
4,964,528 A 10/1990 Wagoner
4,988,216 A 1/1991 Lyman
5,052,185 A 10/1991 Spahr
D325,323 S 4/1992 Kahl
5,103,884 A 4/1992 Roman
D328,389 S 8/1992 Pardo
D330,488 S 10/1992 Daniels
5,181,612 A * 1/1993 Liu ..... A45C 7/0036 206/542
5,215,248 A 6/1993 Moser
5,285,656 A 2/1994 Peters
D353,082 S 12/1994 Keven
D354,419 S 1/1995 Kahl et al.
5,403,095 A 4/1995 Melk
5,509,279 A 4/1996 Brown et al.
5,562,228 A 10/1996 Ericson
5,605,056 A * 2/1997 Brown ..... A01K 97/04 62/457.4
5,622,276 A 4/1997 Simmons
5,669,233 A 9/1997 Cook et al.
D387,249 S 12/1997 Mogil
D391,121 S 2/1998 Melk
5,816,432 A 10/1998 Hammen et al.
5,845,515 A 12/1998 Nelson
5,850,915 A 12/1998 Tajima
5,857,778 A 1/1999 Elis
5,913,448 A 6/1999 Mann et al.
D419,297 S 1/2000 Richardson et al.
D419,767 S 2/2000 Richardson et al.
D419,768 S 2/2000 Richardson et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 * 2/2001 Martin Perianes ..... B65D 81/3823 220/592.03
6,234,677 B1 5/2001 Mogil
6,244,458 B1 6/2001 Frysinger et al.
D444,683 S 7/2001 Corrion
6,276,579 B1 8/2001 DeLoach
D451,765 S 12/2001 Israel et al.
6,325,281 B1 12/2001 Grogan
6,328,179 B1 12/2001 Conrado et al.
D455,934 S 4/2002 Culp et al.
6,409,066 B1 6/2002 Schneider et al.
D465,134 S 11/2002 Joss
6,474,095 B1 11/2002 Chan
6,505,479 B2 1/2003 Defelice et al.
D472,384 S 4/2003 Richardson
6,595,687 B2 7/2003 Godshaw et al.
6,736,309 B1 5/2004 Westerman et al.
6,751,963 B2 6/2004 Navedo et al.
D502,599 S 3/2005 Cabana et al.
6,895,778 B1 5/2005 Ackerman
D513,123 S 12/2005 Richardson et al.
D514,808 S 2/2006 Morine et al.
6,993,931 B1 2/2006 Hamilton
D516,807 S 3/2006 Richardson et al.
D527,226 S 8/2006 Maldonado
D527,953 S 9/2006 Gal
7,140,507 B2 11/2006 Maldonado et al.
7,296,433 B2 11/2007 Uihlein et al.
7,389,608 B1 6/2008 MacKay
7,682,080 B2 3/2010 Mogil
7,791,003 B2 9/2010 Lockhart et al.
7,900,816 B2 3/2011 Kastanek et al.
D635,832 S 4/2011 Bergin
D637,044 S 5/2011 Davis
8,011,194 B2 9/2011 Dimmitt
8,043,004 B2 10/2011 Mogil
8,065,889 B1 11/2011 Silberman
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,424,699 B2 4/2013 Vanderberg et al.
8,430,265 B2 4/2013 Vanderberg et al.
8,448,813 B2 5/2013 Vanderberg et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,863,546 B2 * 10/2014 Oberweis ..... F25D 3/14 220/23.87
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D732,348 S 6/2015 Seiders et al.
D732,349 S 6/2015 Seiders et al.
D732,350 S 6/2015 Seiders et al.
D732,899 S 6/2015 Seiders et al.
9,139,352 B2 9/2015 Seiders et al.
9,187,232 B2 11/2015 Seiders
D752,347 S 3/2016 Seiders et al.
9,316,428 B2 4/2016 Mech
9,389,010 B1 7/2016 Booker
9,408,445 B2 8/2016 Mogil et al.
9,433,200 B2 9/2016 Norman
9,446,847 B2 9/2016 Richardson et al.
9,500,400 B2 11/2016 Smith
9,834,342 B2 4/2017 Seiders
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
D798,670 S 10/2017 Seiders et al.
D799,276 S 10/2017 Seiders et al.
D799,277 S 10/2017 Seiders et al.
D799,905 S 10/2017 Seiders et al.

(56) References Cited

U.S. PATENT DOCUMENTS

| | | | | |
|---|---|---|---|---|
| D801,123 | S | 10/2017 | Seiders et al. | |
| 9,796,517 | B2 | 10/2017 | Seiders et al. | |
| D802,373 | S | 11/2017 | Seiders et al. | |
| D804,905 | S | 12/2017 | Seiders et al. | |
| D805,851 | S | 12/2017 | Seiders et al. | |
| D820,646 | S | 6/2018 | Yockey | |
| D821,165 | S | 6/2018 | Guerdrum et al. | |
| D821,825 | S | 7/2018 | Sullivan et al. | |
| D823,064 | S | 7/2018 | Eichinger et al. | |
| D823,065 | S | 7/2018 | Eichinger et al. | |
| D823,066 | S | 7/2018 | Eichinger et al. | |
| 10,029,842 | B2 | 7/2018 | Seiders et al. | |
| D824,730 | S | 8/2018 | Guerdrum et al. | |
| 10,092,137 | B1 | 10/2018 | Nelson et al. | |
| D835,470 | S | 12/2018 | Seiders et al. | |
| D835,471 | S | 12/2018 | Seiders et al. | |
| D835,472 | S | 12/2018 | Seiders et al. | |
| D835,946 | S | 12/2018 | Seiders et al. | |
| D838,983 | S | 1/2019 | Seiders et al. | |
| D838,984 | S | 1/2019 | Seiders et al. | |
| D840,150 | S | 2/2019 | Seiders et al. | |
| 10,221,005 | B2 | 3/2019 | James | |
| 2003/0038138 | A1 | 2/2003 | Komurke | |
| 2003/0106895 | A1 | 6/2003 | Kalal | |
| 2003/0136702 | A1 | 7/2003 | Redzisz et al. | |
| 2003/0141424 | A1 | 7/2003 | Thomas | |
| 2004/0178208 | A1 | 9/2004 | Leba et al. | |
| 2004/0238543 | A1 | 12/2004 | Askew | |
| 2004/0262319 | A1 | 12/2004 | Fisher | |
| 2005/0006268 | A1* | 1/2005 | Futernick | B65D 21/0233 206/518 |
| 2005/0133557 | A1 | 6/2005 | McKenzie et al. | |
| 2005/0263527 | A1 | 12/2005 | Maldonado et al. | |
| 2005/0263528 | A1 | 12/2005 | Maldonado et al. | |
| 2005/0279123 | A1 | 12/2005 | Maldonado et al. | |
| 2005/0279124 | A1 | 12/2005 | Maldonado | |
| 2006/0180624 | A1 | 8/2006 | Sadow et al. | |
| 2007/0137958 | A1 | 6/2007 | Hamlin | |
| 2007/0278234 | A1 | 12/2007 | Mogil | |
| 2008/0094853 | A1* | 4/2008 | Kim | G02B 6/0018 362/612 |
| 2008/0260303 | A1 | 10/2008 | Lesseux et al. | |
| 2009/0159471 | A1 | 6/2009 | Koppe | |
| 2010/0065466 | A1 | 3/2010 | Perkins | |
| 2010/0072215 | A1 | 3/2010 | Coon | |
| 2010/0287976 | A1 | 11/2010 | Roof et al. | |
| 2011/0056233 | A1 | 3/2011 | Flaker et al. | |
| 2011/0182532 | A1 | 7/2011 | Baltus | |
| 2011/0203297 | A1 | 8/2011 | Oberweis | |
| 2011/0220531 | A1 | 9/2011 | Meether et al. | |
| 2011/0289958 | A1 | 12/2011 | White et al. | |
| 2013/0228583 | A1 | 9/2013 | Mayer | |
| 2013/0264161 | A1 | 10/2013 | Thompson | |
| 2014/0013789 | A1 | 1/2014 | Conrad et al. | |
| 2014/0248003 | A1 | 9/2014 | Mogil et al. | |
| 2015/0158539 | A1 | 6/2015 | Jensen et al. | |
| 2015/0210444 | A1 | 7/2015 | Mercado et al. | |
| 2015/0241107 | A1 | 8/2015 | Mech | |
| 2015/0298886 | A1 | 10/2015 | Knight et al. | |
| 2015/0369529 | A1* | 12/2015 | Monroe | F25D 3/08 62/457.2 |
| 2016/0101924 | A1 | 4/2016 | Mitchell et al. | |
| 2016/0257479 | A1 | 9/2016 | Seiders et al. | |
| 2016/0279840 | A1 | 9/2016 | French et al. | |
| 2016/0347507 | A1 | 12/2016 | Kendrick | |
| 2017/0001785 | A1* | 1/2017 | Ripley | F25D 3/00 |
| 2017/0023289 | A1 | 1/2017 | Anderson | |
| 2017/0073146 | A1 | 3/2017 | Kuhn et al. | |
| 2017/0073147 | A1 | 3/2017 | Kuhn | |
| 2017/0121059 | A1 | 5/2017 | Faris | |
| 2017/0233139 | A1* | 8/2017 | Averill | B65D 25/06 220/533 |
| 2017/0305639 | A1 | 10/2017 | Kuhn et al. | |
| 2017/0350635 | A1* | 12/2017 | Thirumurugavel | F25D 3/14 |
| 2018/0015938 | A1 | 1/2018 | DeFrancia | |
| 2018/0149400 | A1* | 5/2018 | Valencia | F25D 3/08 |
| 2018/0186547 | A1 | 7/2018 | Morine et al. | |
| 2018/0186550 | A1 | 7/2018 | Morine et al. | |
| 2018/0263346 | A1 | 9/2018 | Stephens | |
| 2018/0290814 | A1 | 10/2018 | Smith | |
| 2018/0346229 | A1 | 12/2018 | Guerdrum et al. | |
| 2018/0353379 | A1* | 12/2018 | Chou | A61J 1/165 |
| 2019/0023480 | A1 | 1/2019 | Lin | |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

Best Cooler Reviews, Best Folding and Collapsible Cooler—It's All About Convenience, downloaded from https://pestcooler.reviews/best-folding-collapsible-cooled Jan. 15, 2018, 8 pages.

CleverMade, CleverMade CleverCrates 45 Liter Collapsible Storage Bin/Container; Grated Wall Utility Basket/Tote, Royal Blue, downloaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1 Jan. 15, 2018, 13 pages.

Coleman, 75 Can Collapsible Sport Cooler, downloaded from https://www.coleman.com/large-sport-collapsible/2000015225.html Jan. 15, 2018, 3 pages.

Digital Trends, "The new Venture coolers from Otterbox . . . ", Posted May 9, 2017.(https://www.digitaltrends.com/outdoors/otterbox-venture-coolers/).

Duluth Trading Co, Folding Milk Crate, downloaded from https://www.duluthtrading.com/store/product/folding-milk-crate-78536.aspx on Jan. 15, 2018, 6 pages.

Ice Chest Guide, "Top 10 Best Soft Cooler Reviews and Buying Guide for 2018", downloaded from http://www.cechestguide.com/top-10-best-soft-cooler-reviews-and-buying-guide.html Jan. 25, 2018, 12 pages.

Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.

Kelty Folding Cooler, downloaded from https://www.kelty.com/folding-cooler/ Jan. 18, 2018, 6 pages.

Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.

OtterBox, "Rugged Venture Coolers", Accessed Jan. 16, 2018. (https://www.otterbox.com/en-us/venture-coolers.html).

Pelican Consumer, Coolers—Hunting, Fishing, Camping, downloaded from http://www.pelican.com/us/en/products/coolers May 8, 2017, 2 pages.

Pelican Products, "70QT Cooler", Accessed Jan. 16, 2018. (http://www.pelican.com/us/en/product/outdoor-heavy-dutycoolers/elite-cooler/cooler/70QT/).

Picnic at Ascot, 396-RB 60 Can Collapsible Rolling Cooler, downloaded from http://www.picnicatascot.com/main/default/ProductsDetail.aspx?id=136 Jan. 15, 2018, 2 pages.

Polar Bear Coolers, "24 Pack Eclipse Cooler," downloaded from http://www.polarbearcoolers.com/product/PB327.html Jan. 30, 2018, 6 pages.

Polar Bear Coolers, "Eclipse Backpack Cooler," downloaded from http://www.polarbearcoolers.com/product/PB397.html Jan. 29, 2018, 4 pages.

Rei Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.

RTIC, "RTIC Soft Pack Coolers," downloaded form https://www.rticcoolers.com/shop/coolers/softpak Jan. 25, 2018, 16 pages.

RTIC, Cooler Accessories, downloaded May 8, 2017 from http://www.rticcoolers.com/shop/coolers/accessories, 14 pages.

(56) References Cited

OTHER PUBLICATIONS

Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
Yeti Coolers, "Hopper Soft Sided Portable Coolers," downloaded from https://www.yeti.com/soft-coolers Jan. 25, 2018, 6 pages.
Yeti Coolers, Tundra Cooler Divider, downloaded from www.yeti.com/tundra-dividers May 8, 2017, 4 pages.
Yeti Coolers, Tundra Ice Chests, downloaded from http://yeti.com/tundra May 8, 2017, 7 pages.
Yeti Coolers, Yeti Accessories & Parts, downloaded from http://yeti.com/accessories May 8, 2017, 5 pages.
Amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp_d_product_top?e=UTFB Mar. 11, 2019, 8 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.

* cited by examiner

CONFIGURABLE INSULATED STORAGE CONTAINER

CROSS REFERENCE TO RELATED APPLICATIONS

This application claims priority to U.S. Provisional Patent Application No. 62/508,099, filed May 18, 2017, which is hereby incorporated by reference in its entirety.

FIELD

This disclosure relates generally to portable insulated storage containers for storing or shipping objects, such as food and/or beverages.

BACKGROUND

It is often desirable to bring food or beverages when traveling or when participating in remote leisure activities. Often, the food may be perishable and the ambient temperature may be high (for instance, at a beach location), so it may be desirable to keep the perishable food in a temperature controlled environment to avoid spoiling. Similarly, beverages, such as canned or bottled beverages, may also be consumed, and it is desired to keep such beverages cool until consumption. Storage containers, insulated storage containers, coolers, and/or insulated shipping containers may also be used for a variety of other purposes or activities including hunting, fishing, camping, medical purposes, general storage, grocery delivery, meal kit shipping, other food delivery, and/or other business or personal purposes.

Ice packs, cold packs, and/or cooling packs may be placed in an interior portion of a storage container defined by the side walls and bottom wall to keep the interior portion of the storage container at a desired temperature that is lower than the ambient temperature. In other situations, storage containers of the type described herein may be used to keep one or more items warmer or hotter than the ambient environment. In many cases, the storage container may contain various items that have various temperature needs. It is therefore desirable to be able to configure the storage container to accommodate these varied needs, as well as to be able to easily reconfigure the storage container for subsequent uses which have different temperature or temperature configuration needs.

SUMMARY

Storage containers are used for a variety of purposes and in conjunction with a variety of activities. A storage container may be insulated to assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. While most of the examples discussed herein are discussed with respect to a "cooler," it should be understood that the techniques and features disclosed herein are applicable to other types of storage containers or temperature control containers. Further, storage containers of the type disclosed herein may be used for storage or transportation purposes and need not necessarily include insulating characteristics. The storage containers disclosed herein may be configured to be carried or transported in a plurality of manners or configurations.

In one example, a portable insulated storage container includes an insulated body, an insulated lid, and a retainer. The insulated body has an internal cavity for storing one or more items. The internal cavity is selectively and reversibly configurable into two or more storage areas. The insulated lid engages the insulated body to close the internal cavity. The insulated lid includes two or more receptacles each configured for receiving a cold pack or other thermal device. Each of the two or more receptacles aligns with a respective one of the two or more storage areas when the insulated lid engages the body. The retainer removably retains the cold pack in one of the receptacles.

Other variations and embodiments are possible, including variations and embodiments which do not necessarily include all of the elements described above and/or variations and embodiments which may include additional elements.

DETAILED DESCRIPTION

Figure 1:
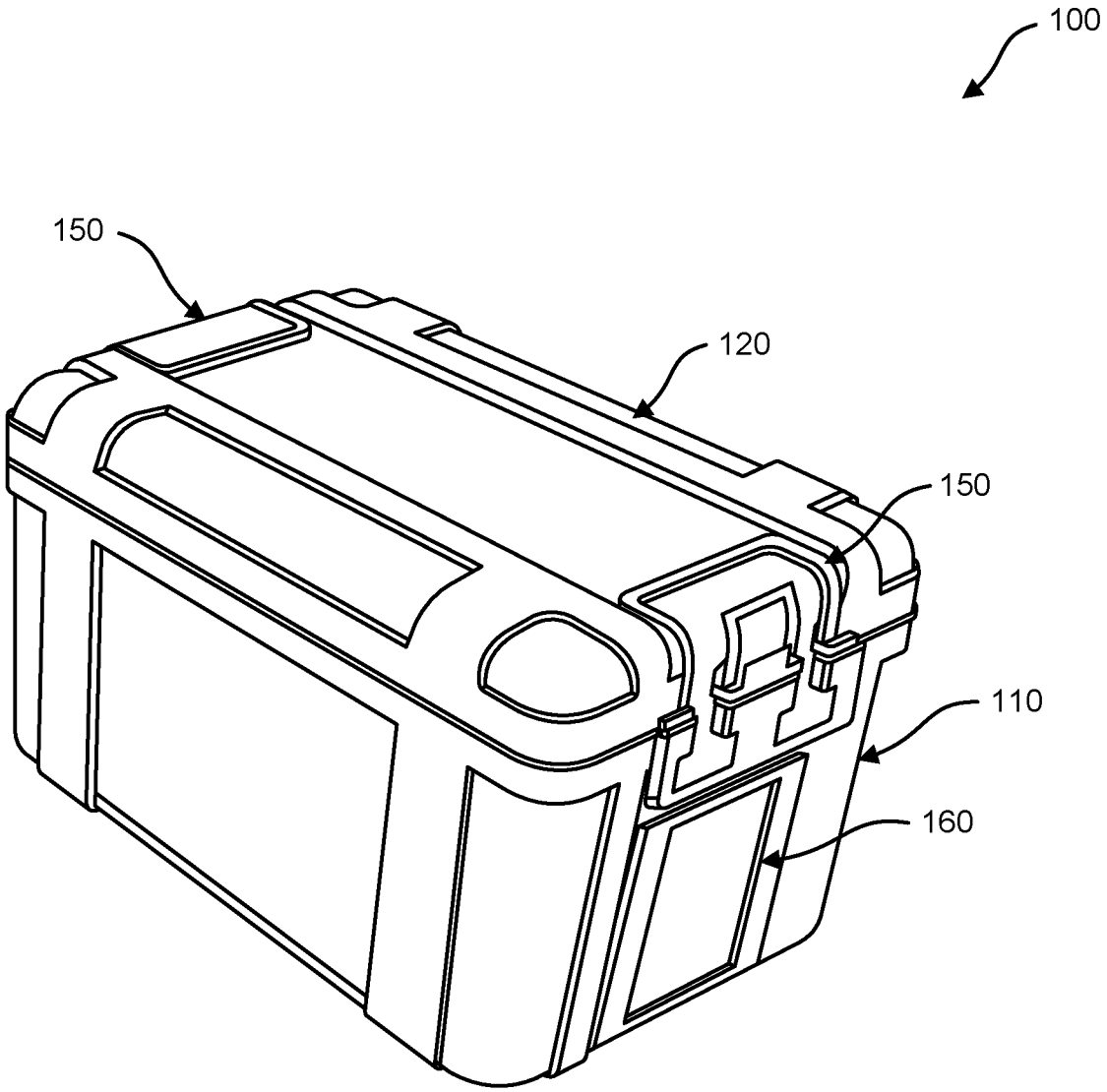
FIG. 1 illustrates a cooler in accordance with the techniques and improvements disclosed herein.

FIG. 1 illustrates a cooler 100 in accordance with the techniques and improvements disclosed herein. Cooler 100 includes a body 110 and a lid 120. Body 110 provides a cavity, storage compartment, storage volume, or storage area (not visible in FIG. 1) which is accessible by removing lid 120 from body 110. Body 110 and/or lid 120 may be made from one or more plastics, food grade plastics, metals, and/or natural materials. Body 110 and/or lid 120 may be molded, injection molded, roto-molded, pressure-formed, 3-D printed, machined, and/or stamped. Each of body 110 and lid 120 may comprise a single component or may be made of multiple components. Each of body 110 and lid 120 may also include insulation or one or more insulating elements, such as foam, expanding foam, closed cell foam, structural foam, spray foam, blanket materials, one or more evacuated cavities, one or more vacuum panels, or combinations thereof. In some examples, one or more insulating or elements or panels may also be replaceable, exchangeable, and/or swappable.

Figure 2:
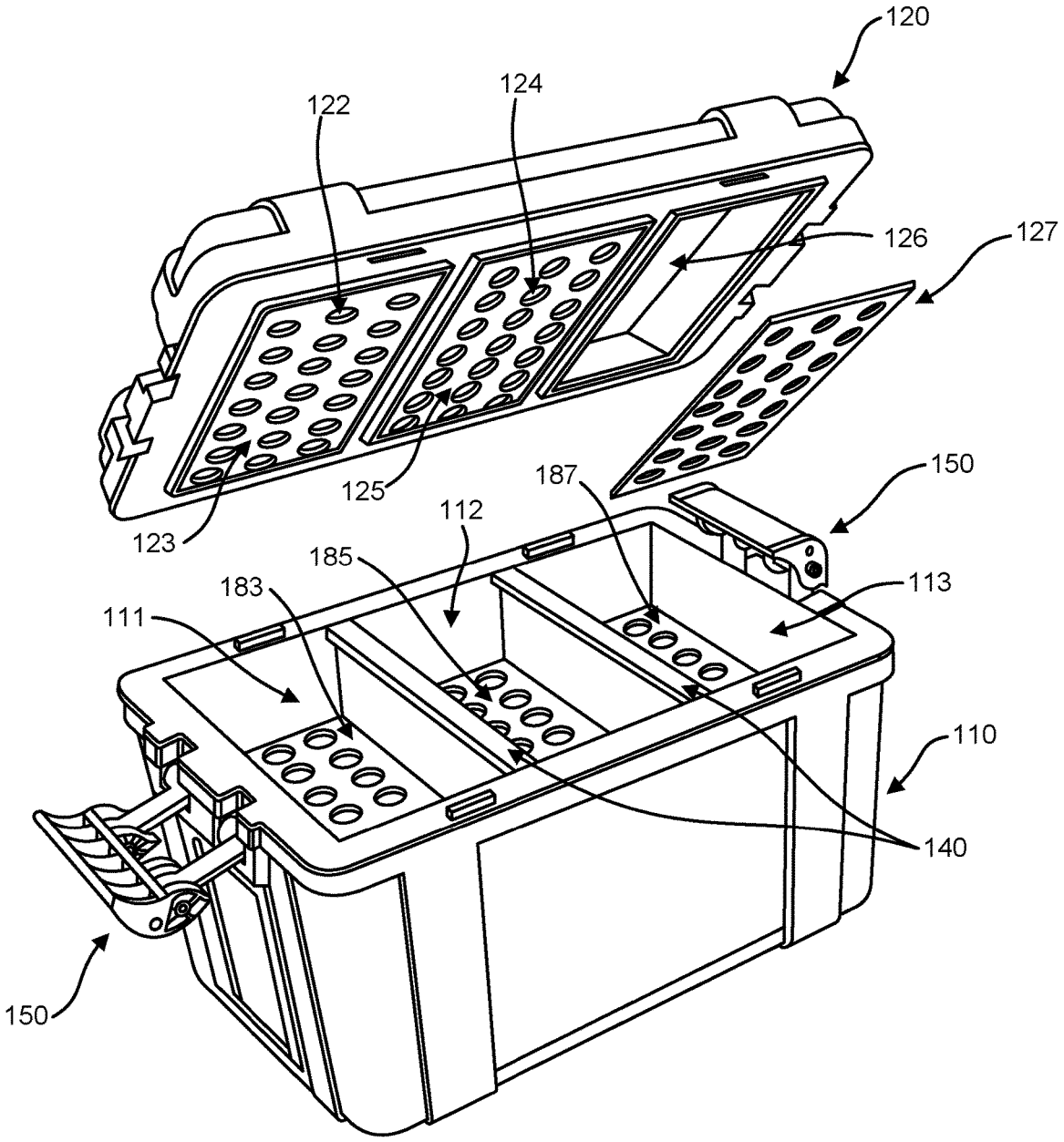
FIG. 2 illustrates a cooler with the lid removed in accordance with the techniques and improvements disclosed herein.

Body 110 and/or lid 120 may be rigid or may contain portions that are flexible, bendable, soft, compliant, stretchable, and/or compressible. In some cases, one or more portions of cooler 100 may be partially or fully collapsible when not in use. Various portions of cooler 100 may be attached using one or more methods including sewing, gluing, adhesive, electro-welding, thermoplastic welding, co-molding, melting, and/or fasteners. Lid 120 may be fully removable from body 110 (as illustrated in FIG. 2) or may be attached to body 110 with a one or more hinges or hinging elements. Lid 120 is removably held in a closed position against body 110 using one or more latches, clasps, fasteners, clips, and/or levers, such as latches 150. Cooler 100 may also include one or more carrying handles which may be integrated with or separate from latches 150.

Body 110 and/or lid 120 also include one or more information panels, such as label receiver 160. Label receiver 160 may be a pouch, pocket, slot, or surface for storing or displaying information about the contents of cooler 100 and/or shipping information for cooler 100. Label receiver 160 may include a substantially clear window or a substantially transparent window. The contents information and/or shipping information may be removable, changeable, or replaceable. One or more parts of cooler 100 and/or cooler 100 may be waterproof, water-resistant, abrasion resistant, tear resistant, and/or puncture resistant.

Latches 150 may provide a closure that is waterproof, water-resistant, childproof, child resistant, animal proof, and/or animal resistant. Latches 150 may include one or more components made of plastic, metal, wood, ceramic, rubber, and/or silicone. Further, latches 150 may include a locking mechanism or may include an interface for use with one or more locks or access control devices, such as an electronic lock or a seal which indicates opening or tampering. One or more gaskets or seals may be used between lid 120 and body 110.

Cooler 100 may also include one or more attachment areas or attachment points for removably attaching one or more accessories or other items to cooler 100. Attachment points may include any of a variety of attachment mechanisms, structures, elements, or features including any described in U.S. patent application Ser. No. 15/398,468, filed Jan. 4, 2017, which is hereby incorporated by reference in its entirety.

FIG. 2 illustrates cooler 100 with the lid 120 removed from body 110 to expose or access a cavity or storage volume inside cooler 100. In the example of FIG. 2, the storage volume is broken into three separate storage areas: storage area 111, storage area 112, and storage area 113. The storage areas are separated by internal walls 140. Internal walls 140 may be insulated in addition to the outer walls and/or bottom of body 110 being insulated. It should be understood that although many of the examples herein describe coolers with two or three compartments or storage areas, additional compartments or storage areas are possible.

Beneficially, different types of items with different requirements can be stored in each of the different storage areas. The requirements of the items may vary based on temperature requirements. In one example, one storage area may be used for frozen items, while the second is used for cold beverages, and the third is used for items which must kept cool but may be sensitive to extreme cold, such as sensitive vegetables. A grocery delivery company or meal kit company may place different products, groups of products, or ingredients in different storage areas or compartments that will be configured for different temperatures. The features described herein enable the temperatures of the individual storage areas of cooler 100 to be individually planned and managed. The features also allow cooler 100 to be easily reconfigured for different storage or shipment needs where the temperature needs are different and/or the quantities of goods in any particular temperature category are different. In this way, cooler 100 may be repeatedly reused while being adapted or configured to be better suited for each use.

In some examples, one or more of the storage areas or compartments may be used for items that preferably remain at room, neutral, or outside temperature. In other examples, one or more of the storage areas or compartments may be used for items that must be kept warm or hot relative to other items. In yet other examples, various areas may be used for pharmaceuticals or other medical items that have different temperature requirements. The different storage areas or compartments may also be used for items or groups of items that have varying levels of sensitivity to humidity or liquid.

FIG. 2 also illustrates receptacles 122, 124, and 126 in lid 120 which correspond to storage areas 111, 112, and 113, respectively, when lid 120 is attached to body 110. Receptacles 122, 124, and 126 may each be used for holding one or more ice packs, cold packs, gel packs, instant ice packs, ice, dry ice, hot packs, temperature maintenance devices, and/or other thermal items for maintaining or controlling a temperature in the respective storage area. Beneficially, the amounts, types, sizes, and/or quantities of ice packs, cold packs, or other thermal devices placed in each of receptacles 122, 124, and 126 may be varied based on a number of factors including: the desired temperature in the associated storage area, the expected shipping or storage time, the types of items in the associated storage area, the number or quantity of items in the associated storage area, the initial temperature(s) of the items in the associated storage area, and/or the expected ambient conditions. In this way, the temperature, humidity, and/or other storage conditions for each of storage area 111, 112, and 113 may be independently planned or controlled. Accordingly, the types, sizes, numbers, and/or quantities of ice packs, cold packs, ice, dry ice, or other thermal devices placed in each of receptacles 122, 124, and 126 may be separately selected to accomplish these objectives.

In some examples, one or more ice packs or hot packs may be permanently, or semi-permanently, attached or integrated into body 110 and/or lid 120. In these examples, the entire body 110 and/or lid 120 may be heated, cooled, or frozen before use. For example, a body 110 may be packed with items and then a pre-frozen lid that includes ice packs may be attached.

In one example, dry ice may be used in receptacle 122 to keep items in storage area 111 frozen, while a cold pack is used in receptacle 124 to keep items in storage area 112 cold, but not frozen. At the same time, a different type of cold pack or a smaller cold pack may be used in receptacle 126 to keep items in storage area 113 cool, but not as cold as those in storage area 112. In another example, different quantities of a same cold pack may be used in each of the receptacles to maintain different temperature targets of each storage area. The number or type of cold packs associated with each storage area may also be selected, at least in part, by the quantity, initial temperature, and/or thermal mass of the items being placed into each storage area.

In some cases, one or more other environmental control items may be included in one or more of the receptacles, such as a desiccant or an odor control device.

In other examples, one or more of the storage areas may have no associated cold packs or other cooling devices.

Grocery delivery or meal kit providers may utilize these features to keep different items, or groups of items, closer to their preferred shipping or storage temperatures. For example, some items may not need any cooling or refrigeration and concentrating the cooling packs to the storage areas where cooling is needed may improve performance and/or reduce the size or quantity of cooling packs which are needed. In some cases, one or more of the cooling pack receptacles and/or storage areas may be left empty for a particular shipment.

Beneficially, receptacles 122-126 are located in lid 120 such that cool or cold air from them naturally drops, moves, or migrates down to the items in the respective storage areas below through normal convection processes. In many situations, this provides an improvement over packing items on top of ice or cold packs and also allows the ice or cold packs to be replaced without removing the items. Locating the receptacles in the lid also provides efficiencies and improvements for assembly lines where the receptacles of lid 120 can be populated and readied separately from the packing of items into body 110 before body 110 and lid 120 come together. They can also be separately processed and/or cleaned when cooler 100 is returned to a provider.

Each of receptacles 122-126 may also include or utilize a retainer, such as retainers 123, 125, and 127, for removably retaining one or more ice packs, cold packs, gel packs, instant ice packs, ice, dry ice, hot packs, and/or other thermal items in the associated receptacle. Each retainer may include a number of holes for allowing temperature transfer and air movement. The retainer may be configured as a sheet with holes, a mesh, a screen, a grate, a net, a lattice, or any other structure which will retain items in the receptacles while allowing airflow and/or convection. In some examples, the retainer may be made from a stretchable material, such as silicone, which is stretched and attached over hooks or other attachment features such that the tension keeps it in place until it is intentionally removed. In some cases, the number and/or sizes of the holes in the retainer may be selected in order to control the cooling effect and/or lifetime of the retained cooling pack.

In some examples, each retainer may snap into place or may provide access to the associated receptacle using one or more hinges or hinging elements. Further, a retainer may engage the receptacle using any type of fastener, clip, buckle snap, rotating pin, interference fit, bending, flexing, adhesive, magnetic elements, threaded elements, hook and loop fastener, or other attaching means to temporarily and removably hold the retainer in place.

While the storage areas in FIG. 2 are illustrated as being of approximately equal size to each other, the improvements herein may be extended to configurations in which the storage areas have different sizes or shapes, including from each other. While the receptacles in FIG. 2 are illustrated as being of roughly equal size to each other, the improvements herein may be extended to configurations in which the receptacles have different sizes or shapes, including from each other. Any of the storage areas may also include a shelf, a vented shelf, a grate, a tray, and/or a rack for keeping items in the storage area from sitting in water or other liquid that may have accumulated at the bottom of the storage area.

In some examples, one or more of the storage areas may also include a receptacle and/or grate or retainer in or near a bottom portion of the storage area, similar to the receptacles in lid 120, for adding additional cold packs, ice packs, or other thermal elements. For example, one or more of grates 183, 185, and 187 may be used to separate stored items from ice, water, and/or cold packs. Grates 183, 185, and 187 may be optional, adjustable to different height levels, include different sized holes or ports, and/or include no holes or ports.

Figure 3:
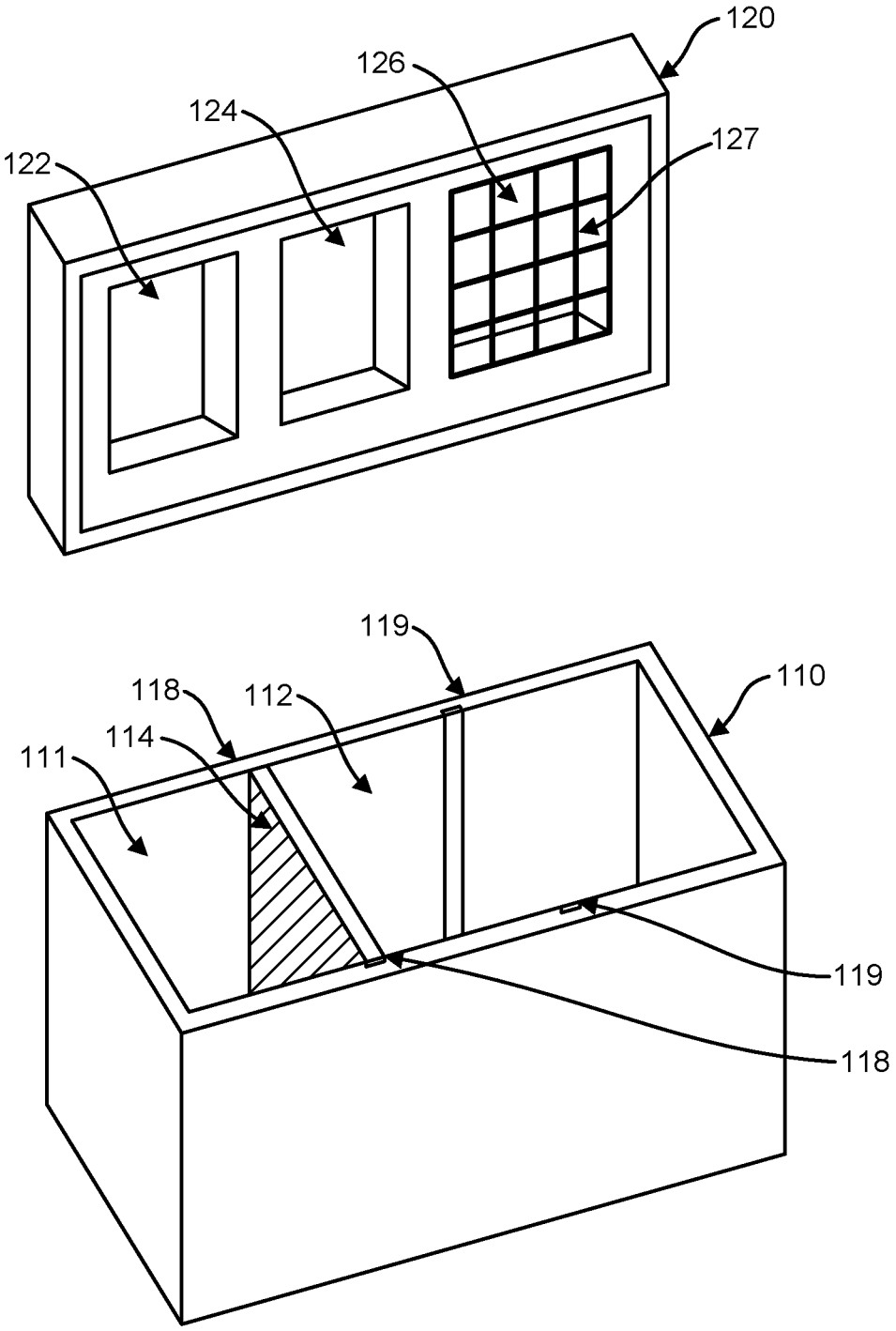
FIG. 3 illustrates a cooler with a divider in accordance with the techniques and improvements disclosed herein.

FIG. 3 illustrates a variation in which one or more removable dividers, such as divider 114, are used to establish or separate the storage areas. Divider 114 inserts into one or more slots, grooves, or guides, such as slots 118 or slots 119, to keep divider 114 removably in place. Slots 118 and/or 119 may extend across all, or only portions, of any of the walls or bottom of body 110, and/or an interior surface of lid 120. Divider 114 may or may not be insulated and/or may have a same or different amount of insulation than a side wall of body 110. Divider 114 may utilize any of the types of insulation disclosed herein.

In some configurations, one or more of body 110 and lid 120 may have a port or aperture that extends through one of the surfaces, such as a wall of body 110. The port may be used for draining liquid and may include a lid or cap. In other configurations, the port may be fitted with a valve for releasing or equalizing gas pressure, purging, or filling with a gas other than air. In some cases, the valve may be a breather valve and may include a filter. In other cases, the valve may be a one way valve.

Figure 4:
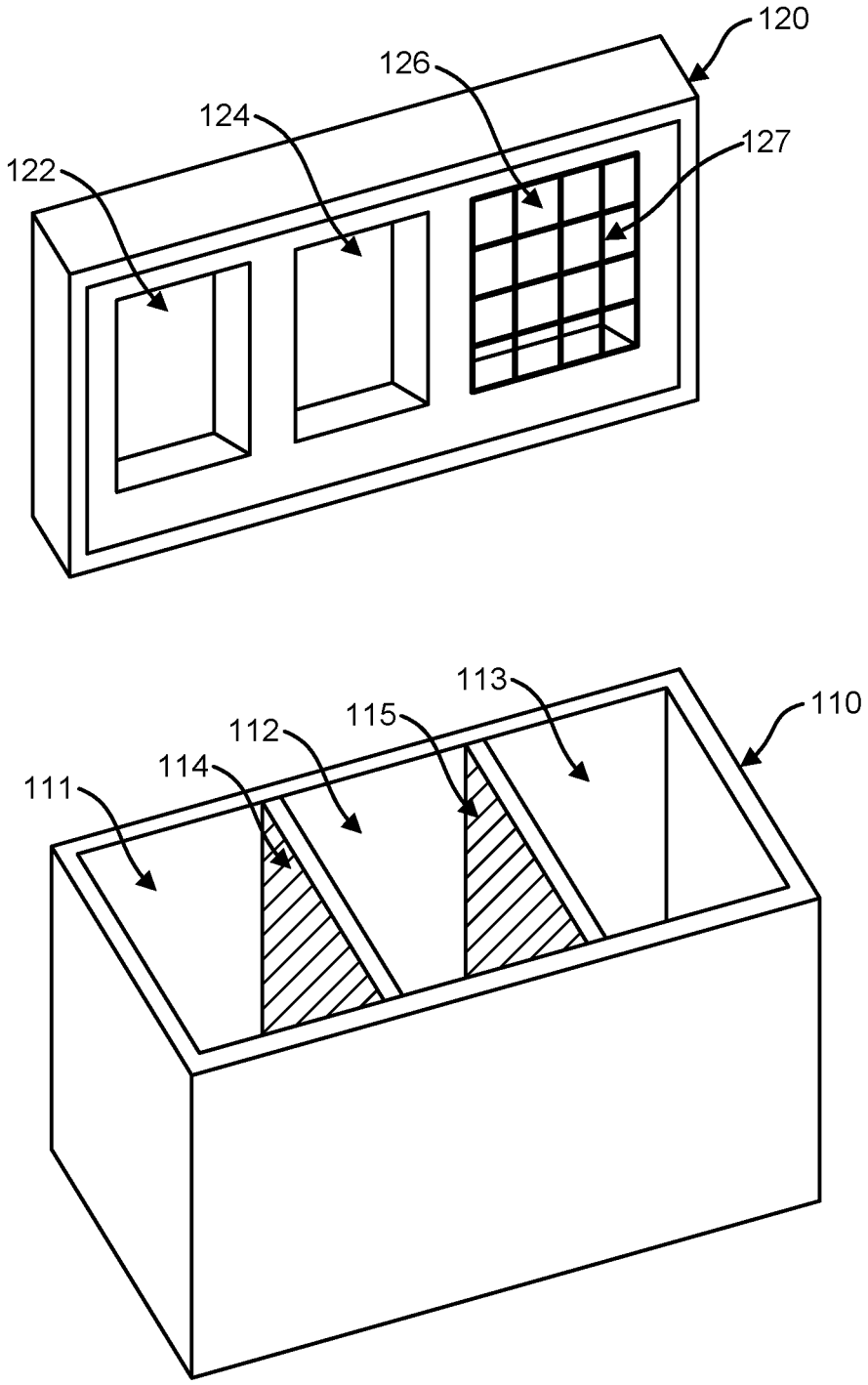
FIG. 4 illustrates a cooler with two dividers in accordance with the techniques and improvements disclosed herein.

FIG. 4 illustrates a configuration in which a second divider, divider 115, is also present and removably inserted into body 110. Beneficially, only the currently needed number of dividers must be used to produce the needed number of distinct storage areas at any particular time in body 110 of cooler 100. This may be reconfigured at any time and the contents of receptacles 122-126 adjusted accordingly. While only one retainer 127 is shown in FIGS. 3-6 for illustration purposes, additional retainers are possible and may be used with the other receptacles. In the example of FIG. 3, the contents of both receptacle 124 and 126 may be selected or adjusted to control the conditions in storage area 112, since no divider is present in slot 119. In this way, further configurations and re-configurations of cooler 100 are possible based on the quantity or size of items which are desired to be subjected to the same set of storage conditions or parameters. In some configurations, many sets of divider slots may be included even though only a smaller number is used at any one time in order to maximize configurability options. In some examples, one or more horizontal dividers and/or retainers may also be used, in place of or in addition to vertical dividers. In some cases, they may be used as a 'false bottom' to temporarily reduce the volume of the cooler for smaller shipments and/or to provide a more significant separator between the items and dry ice.

Figure 5:
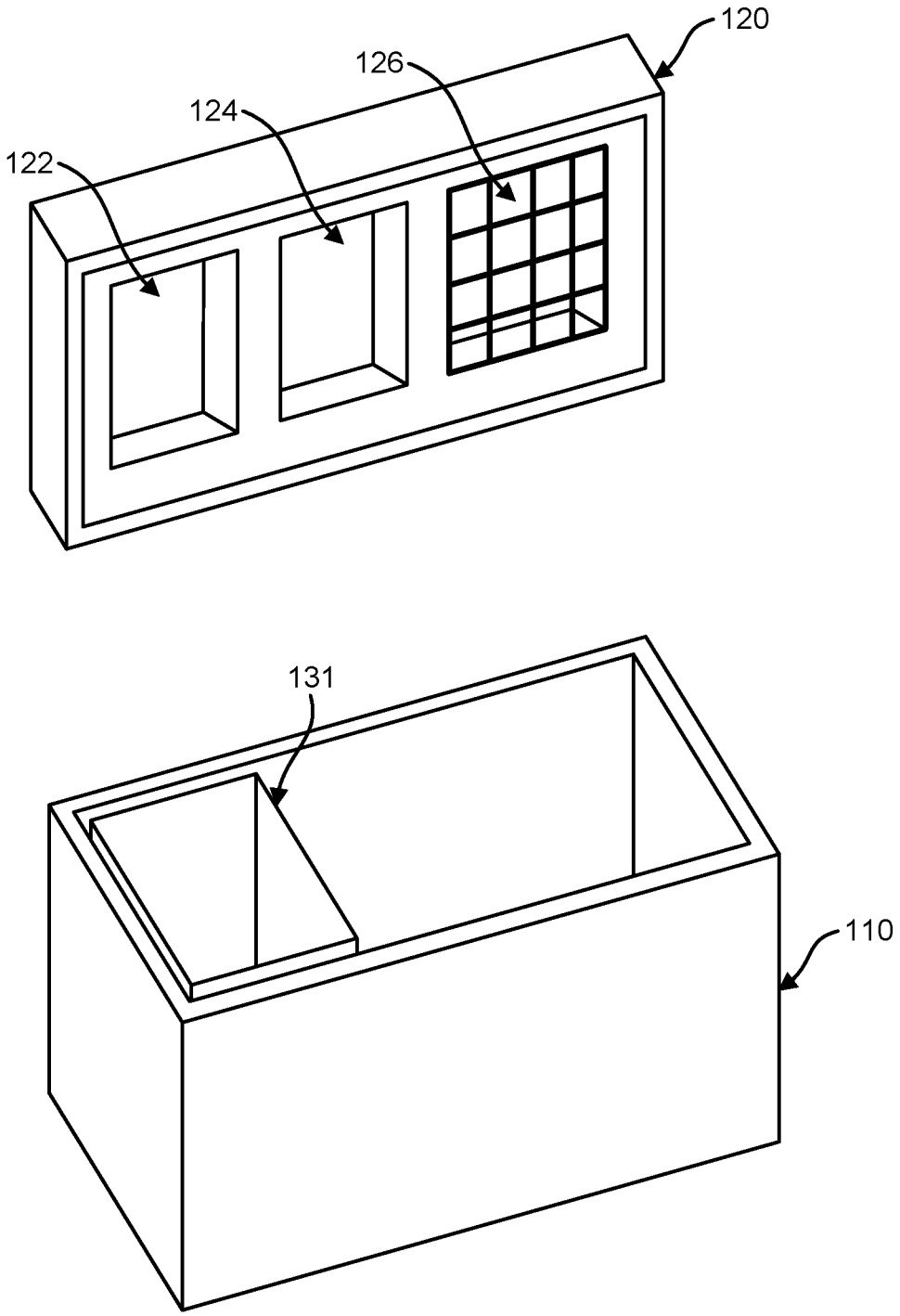
FIG. 5 illustrates a cooler with a bin in accordance with the techniques and improvements disclosed herein.

FIG. 5 illustrates an alternate method of establishing or isolating one or more storage areas within body 110. Rather than utilizing a divider that makes up only one wall of a particular storage area, a bucket or bin, such as bin 131, is used to establish one or more separated storage areas in body 110. Bin 131 interfaces to receptacle 122 when lid 120 is closed to provide a partially or fully enclosed storage area that is separate from the other storage area(s). In some cases, a top edge of bin 131 may seal to lid 120 to create a storage area that is liquid and/or odor tight relative to the rest of body 110 when lid 120 is closed. Bin 131 may be held in place in body 110 using one or more slots, grooves, detents, guides, rails, protrusions, and/or fasteners.

Figure 6:
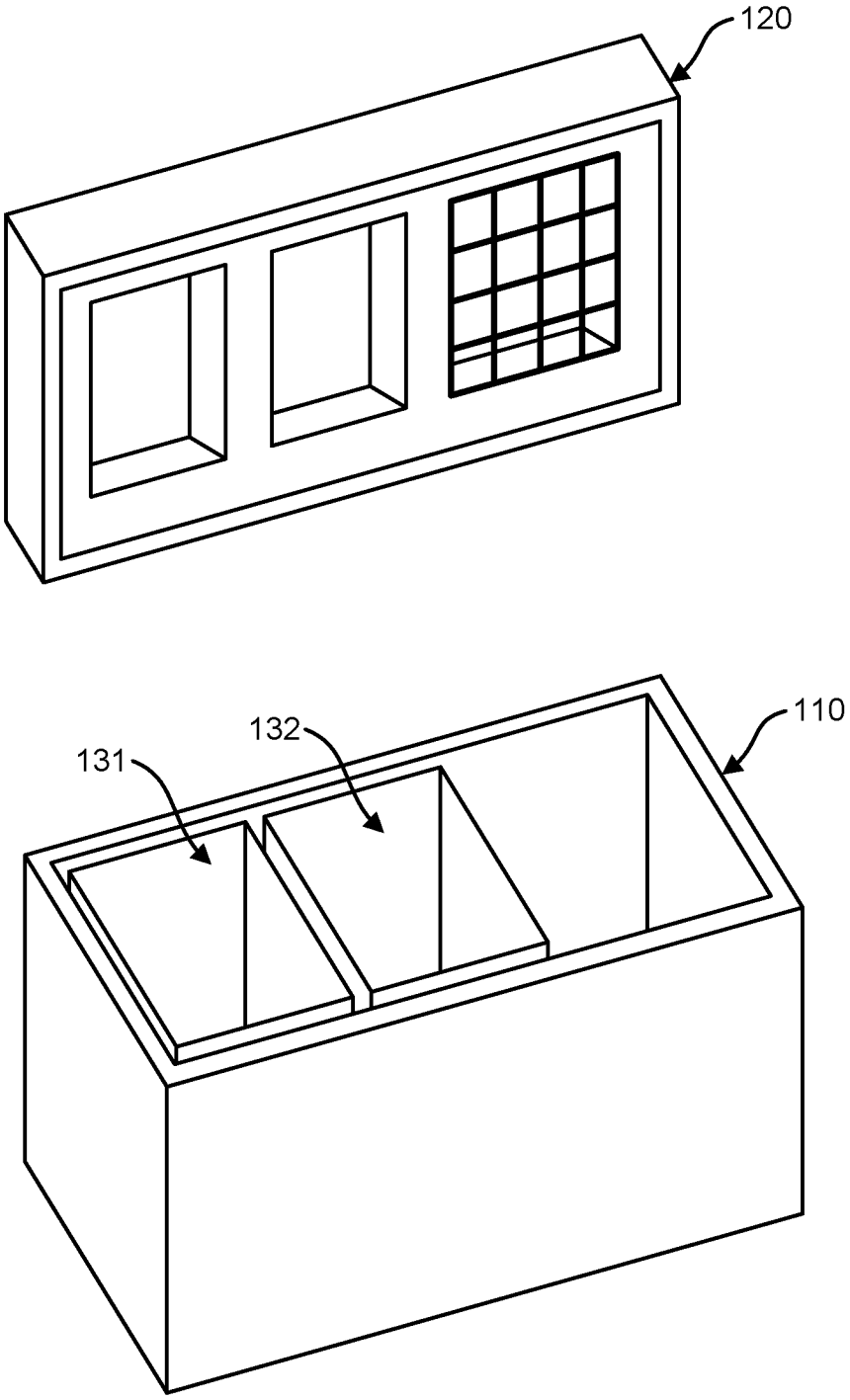
FIG. 6 illustrates a cooler with two bins in accordance with the techniques and improvements disclosed herein.

In FIG. 5, the storage space outside of bin 131 inside body 110 may be used for storage without using any other bins or dividers. Alternately, as illustrated in FIG. 6, additional bin(s), such as bin 132, may be used with the remaining available storage space. As discussed in previous examples, the contents of any of receptacle 122, 124, and 126 may be selected based on the contents of the associated storage area and the preferred temperature characteristics of the items stored in that area. In other words, different quantities or types of cooling packs may be chosen for each of receptacles 122, 124, and 126, based on what items will be stored in each of the associated storage areas or bins and the temperature requirements of those items.

Beneficially, bins 131 and 132 may also provide better isolation between storage areas. In addition, bins 131 and 132 may be separately packed, filled, and/or temporarily stored before being placed into body 110 for shipping or transport. This flexibility allows high volume assembly and fulfilment operations to pack, fill, and handle bins of varying contents and insert them into body 110 at or near the end of assembly operation without having to move or carry body 110 through the entire packing operation and without having to bring the various bins which may make up a shipment together until at or near the end of the assembly operation or process. This may allow individual bins to be packed or stored in different locations until they are used.

Bins 131 and 132 may be used with cooler bodies of various sizes. For example, bin 131 or 132 may be used with a cooler body that holds or accommodates up to 2, 3, 4, 5, 6, 7, 8, 9, 10, or any other number of bins. In some cases, bins of different sizes may also be used. In one example, referring to FIG. 5, a bin twice the size of bin 131 may be used along with bin 131 taking up the remaining space in body 110. In other examples, reliability and efficiency of packing processes may be improved by color coding the bins to correlate them to the types of contents and/or to the preferred temperature range of the contents. In further examples, the retainers and/or the cold packs themselves may be color coded to match the bins in order to improve the efficiency and reliability with which a cooler is configured and filled.

Bin 131 and/or bin 132 may or may not have insulated walls and may have varying amounts of insulation relative to each other. Similarly, bin 131 and/or bin 132 may have some walls that are insulated and some that are not such that when insulation is not duplicated. For example a side wall of bin 131 may not have insulation such that when it is placed next to the complementary insulated wall of bin 132 there are not two layers of insulation. Other configurations and combinations are possible.

The use of bins may also provide benefits relative to cleaning and sanitation. If food storage/contact is limited to bins and lid 120, body 110 may be subject to less stringent cleaning, sanitation, and/or material requirements. In some configurations, a separate lid may also be used with each of the bins to provide further isolation and/or to also subject lid 120 to the less stringent cleaning or sanitation requirements.

In addition to the primary internal storage areas or compartments, cooler 100 may also include one or more other storage areas, storage pockets, or storage compartments for carrying other items. Cooler 100 may also include one or more other accessories, such as a rechargeable battery, a solar cell, a light, a liquid storage bladder, a first aid kit, a toolkit, and/or one or more thermometers for indicating a temperature of one or more of the storage areas. In some configurations, one or more of the additional pockets, storage compartments, and/or dry storage areas may be accessible at an interior surface of cooler 100. Other configurations are possible.

Body 110 and lid 120 may also have features which allow multiple instances of cooler 100 to be stacked on top each other in a stable manner. These features may include protrusions, divots, fingers, recesses, pins, pockets, grooves, tracks, holes, and/or rails. Further, body 110 and/or lid 120 may have tapered walls such that multiple instances of either may be stacked on each other in a nested fashion for space efficiency when they are not in use.

In addition, cooler 100 may include one or more powered cooling or heating units for assisting in keeping items cold or warm, respectively, before transport, after delivery, and/or for some portion of the shipping process. In other words, the features disclosed herein may be supplemented by a powered cooling or heating unit when power is available and cooler 100 can be attached to the power source. In further examples, cooler 100 may include one or more contained power sources, such as a battery or solar panel, for temporarily providing power to the cooling or heating unit without tethering it to a power source.

Figure 7A:
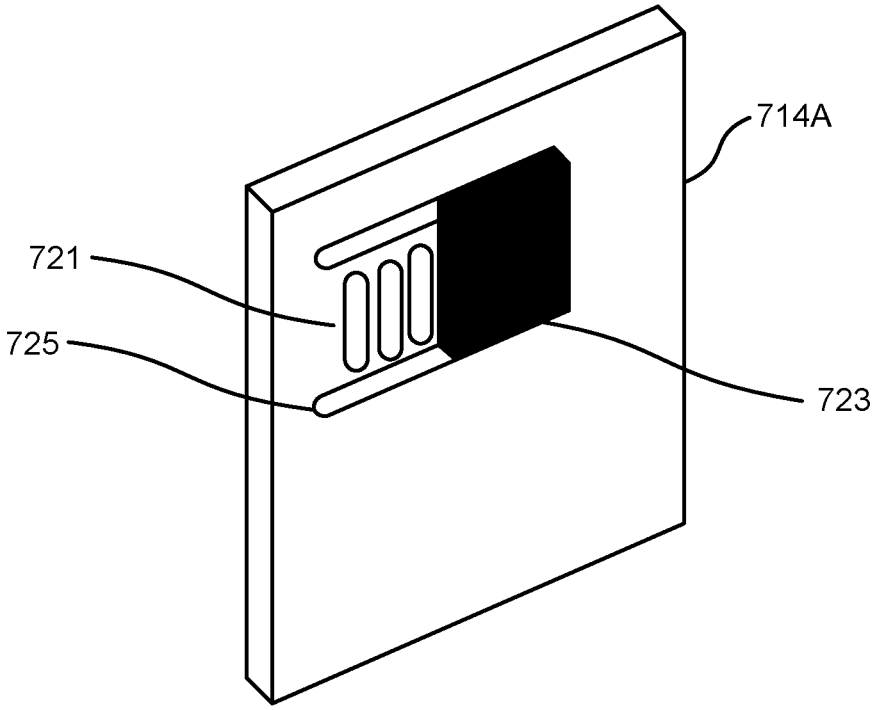
FIG. 7A illustrates a divider having an adjustable vent in accordance with the techniques and improvements disclosed herein.

FIG. 7A illustrates a divider 714A having an adjustable vent 721 in accordance with the techniques and improvements disclosed herein. Divider 714A may be an example of divider 114 and/or divider 115 and may have any of features, functions, and/or characteristics of divider 114 and/or divider 115.

Divider 714A further includes vent 721 which allows air to pass through from one side of divider 714A to the other side of divider 714A. Vent 721 may also be referred to as an aperture, a port, an opening, a baffle, a passage, and/or a window. Divider 714A may be installed in cooler 110 of FIG. 3 instead of divider 114. In this configuration, went 721 allows air to pass between storage area 111 and storage area 112 even though lid 120 may be in a closed position. This configuration allows temperature adjustments between storage area 111 and 112 to happen gradually over time. For example, frozen items may be packed in storage area 111 with a lot of ice while cooled items are packed in storage are 112 with less ice, or no ice. Over time, vent 721 allows some of the colder air from storage area 111 to migrate, move, convect, exchange, and/or transfer to storage area 112.

Divider 714A also includes a door 723, which may also be called a cover. Door 723 slides on slots 725, which may also be called guides, tracks, or rails. Door 723 may be moved or adjusted on slots 725 to expose or cover varying or chosen amounts of vent 721 to either increase or decrease the effect of vent 721. Slots 725 may contain notches or detents to make it easy to get door 723 into a chosen position and to tend to keep it there despite vibration.

Figure 7B:
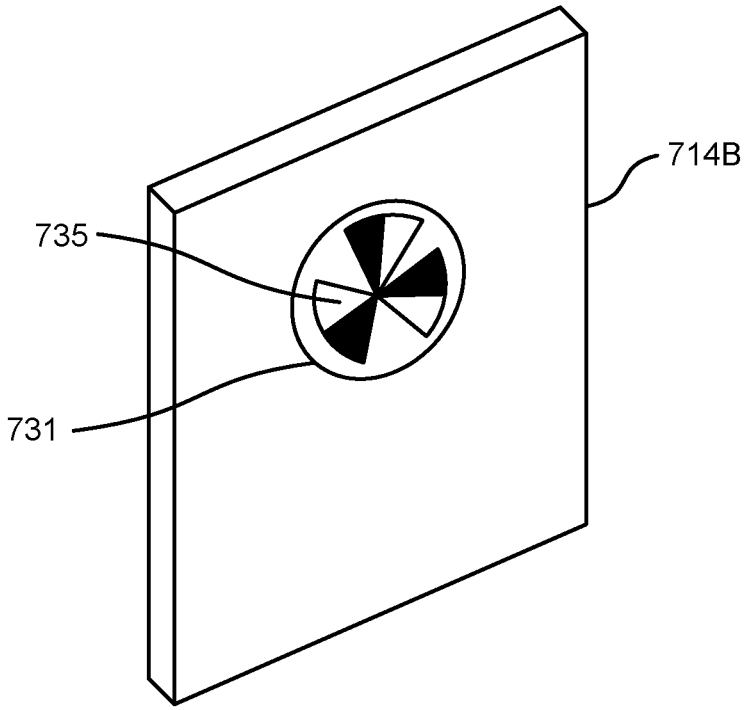
FIG. 7B illustrates another embodiment of a divider having an adjustable vent in accordance with the techniques and improvements disclosed herein.

It should be understood that vent 721 and door 723 may have a variety of shapes, sizes, configurations, or quantities that provide similar results. For example, FIG. 7B illustrates and alternate configuration in which baffle 731 is rotatable on divider 714B to cover or expose various amounts of port 735 which extends through divider 714B.

Figure 8A:
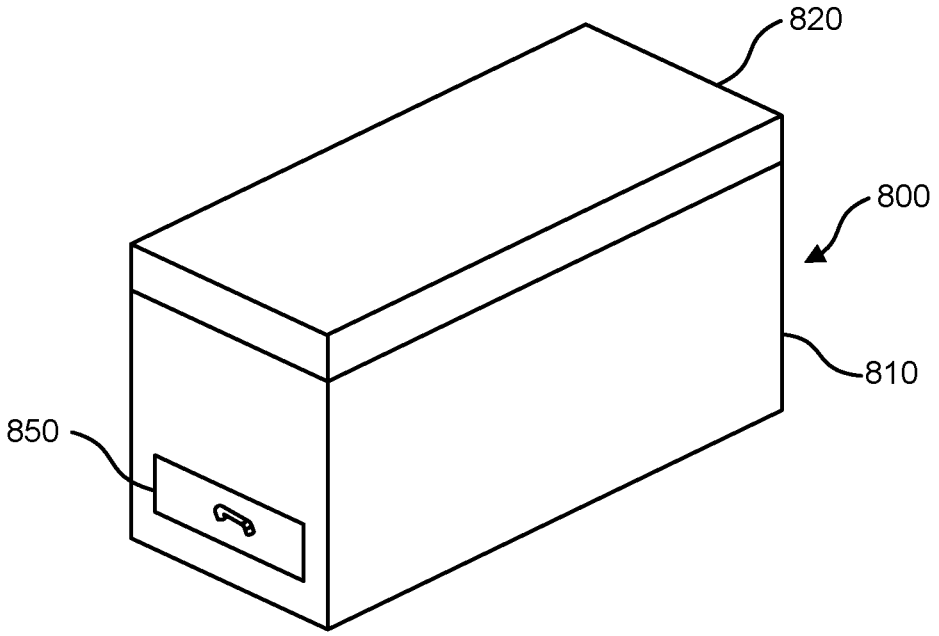
FIG. 8A illustrates a cooler with a sliding tray in a closed position in accordance with the techniques and improvements disclosed herein.
Figure 8B:
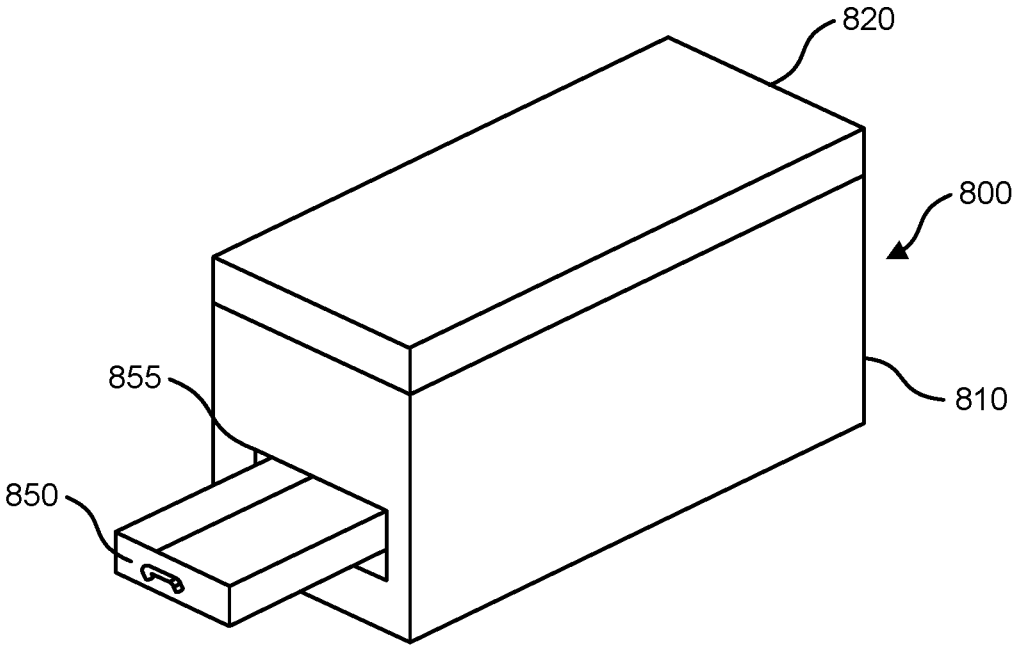
FIG. 8B illustrates the cooler of FIG. 8A with the sliding tray in an open position in accordance with the techniques and improvements disclosed herein.

FIG. 8A illustrates a cooler 800 having a body 810 and a lid 820. Cooler 800 may be an example of cooler 100 and may include any of the features, functions, and/or characteristics of cooler 100. Cooler 800 includes a sliding drawer 850. In FIG. 8A, drawer 850 is in a closed position. In FIG. 8B, drawer 850 is in an open position. Drawer 850 extends through an opening 855 in at least one wall of cooler 800. Drawer 850 may be used to place or replace temperature or thermal maintenance devices in cooler 800. In other words, drawer 850 may be used add or replace cold packs, ice packs, ice, dry ice, and/or hot packs to cooler 800. Some or all of the items stored in cooler 800 may sit in a shelf, grate, screen, or tray which holds them above drawer 850 inside cooler 800 such that drawer 850 can operate freely without being in contact with the stored items. Beneficially, this configuration allows one or more thermal management devices to be replaced or added to cooler 800 without disturbing the stored items, without removing the stored items, and without opening lid 820.

Any of the components disclosed herein may include or may be coated with an anti-microbial and/or anti-viral substance or ingredient.

Any of the techniques, improvements, features, functions, or processes described herein may be implemented in the form of a system or a kit. The system or kit may include any combination of the devices, components, elements, and/or modules disclosed herein.

The techniques, elements, components, methods, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "on other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure is presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A configurable insulated storage container comprising:

a first removable bin and a second removable bin, the first removable bin comprising a first color and defining a first storage area, the second removable bin comprising a second color and defining a second storage area, the first color and the second color each corresponding to a preferred temperature range of contents of the corresponding removable bin;

an insulated body having an internal cavity configured for receiving the first removable bin and the second removable bin, the internal cavity at least partially bounded by a bottom and a plurality of walls;

an insulated lid configured to engage the insulated body to close the internal cavity, the insulated lid including two or more receptacles each configured for receiving a cold pack, each of the two or more receptacles aligning with a respective storage area of one of the first and second removable bins when the insulated lid engages the body; and two or more retainers, each retainer configured for engaging the insulated lid proximate a respective one of the two or more receptacles for removably retaining the respective cold pack in the respective receptacle, each retainer including two or more apertures configured for permitting temperature transfer and air movement between one of the two or more receptacles and a corresponding aligned storage area of the first and second storage areas when the insulated lid engages the body.

2. The configurable insulated storage container of claim 1 wherein internal surfaces of at least some of the plurality of the walls or an internal surface of the bottom of the insulated body include grooves configured for receiving the first removable bin.

3. The configurable insulated storage container of claim 1 wherein an internal surface of the insulated lid is configured for sealing to the first removable bin.

4. The configurable insulated storage container of claim 1 wherein each of the first removable bin and the second removable bin includes an insulated wall.

5. The configurable insulated storage container of claim 1 wherein at least one aperture of the two or more apertures in at least one retainer of the two or more retainers is adjustable.

6. The configurable insulated storage container of claim 1 further comprising an adjustable baffle configured for selectively controlling an amount of airflow from the first storage area to the second storage area.

7. The configurable insulated storage container of claim 1 further comprising a one-way breather valve extending between the internal cavity and an area outside the configurable insulated storage container.

8. The configurable insulated storage container of claim 1, further comprising two or more grates each including a plurality of apertures therethrough, each grate being positioned in one of the two or more storage areas and configured to separate the stored items from a cold pack positioned near the bottom of the insulated body.

9. The configurable insulated storage container of claim 1, wherein the two or more receptacles in the insulated lid comprise a first receptacle associated with the first removable bin and configured to receive a first cold pack and a second receptacle associated with the second removable bin and configured to receive a second cold pack, the first cold pack comprising the first color and corresponding to the preferred temperature range of the contents of the first removable bin and the second cold pack comprising the second color and corresponding to the preferred temperature range of the contents of the second removable bin.

10. A configurable cooler system comprising:

a first removable bin and a second removable bin, the first removable bin having a first color and defining a first storage area, the second removable bin having a second color and defining a second storage area, the first color and the second color each corresponding to a preferred temperature range of contents of the corresponding removable bin;

an insulated container including:

an insulated storage portion having an internal cavity bounded at least in part by walls and a bottom, the internal cavity configured for receiving the first removable bin and the second removable bin; and an insulated lid portion configured to engage the insulated storage portion to selectively close the internal cavity; and two retainers, each retainer configured for engaging a respective receptacle in the insulated container, each receptacle configured for removably retaining one or more temperature maintenance devices in the receptacle, each retainer associated with at least one of the first and second storage areas.

11. The configurable cooler system of claim 10 further comprising a top edge of the first removable bin configured for forming a liquid resistant seal between the first removable bin and the insulated lid portion.

12. The configurable cooler system of claim 10 wherein opposing walls of the insulated storage portion include grooves configured for receiving the first removable bin.

13. The configurable cooler system of claim 10 wherein the walls of the insulated storage portion taper outward from the bottom such that another instance of the insulated storage portion may at least partially nest within the internal cavity when the insulated lid is not present.

14. The configurable cooler system of claim 10, further comprising:

a drawer adapted to slide out from a wall of the insulated container, the drawer adapted to be slidable to an open position for receiving one or more cold packs from an area outside the insulated container and slidable to a closed position adapted for positioning the one or more received cold packs proximate the internal cavity of the insulated container.

15. The configurable insulated cooler system of claim 14 further comprising a vented shelf in the insulated container, wherein the drawer is proximate the bottom of the insulated container and the vented shelf is adapted for holding the stored items above the drawer in the insulated container.

16. The configurable insulated storage container of claim 14 wherein the drawer includes two or more compartments, each compartment associated with a respective one of the first and second storage areas, each of the two or more compartments being positioned directly below a shelf, grate, screen, or tray for storing items in the internal cavity and positioned proximate the respective storage area when the drawer is in the closed position.

17. The configurable cooler system of claim 10 further comprising a first temperature maintenance device of the first color and configured to be retained by a first retainer of the two retainers and a second temperature maintenance device of the second color and configured to be retained by a second retainer of the two retainers, the first retainer being associated with the first storage area and the second retainer being associated with the second storage area, the first and the second color each corresponding to a preferred temperature range of contents of the corresponding removable bin.

18. The configurable cooler system of claim 10, wherein the second removable bin is twice the size of the first removable bin.

19. The configurable cooler system of claim 10, wherein the first removable bin includes at least one insulated wall and the second removable bin includes at least one non-insulated wall, the insulated wall of the first removable bin being configured to be placed next to the non-insulated wall of the second removable bin when the internal cavity receives the first and second removable bins.

20. The configurable cooler system of claim 10 further comprising a third retainer configured for engaging a respective third receptacle in the insulated container and associated with a third storage area, the third receptacle configured for removably retaining one or more temperature maintenance devices in the third receptacle.

* * * * *